US010563276B2

(12) United States Patent
Sun et al.

(10) Patent No.: US 10,563,276 B2
(45) **Date of Patent: *Feb. 18, 2020**

(54) HIGH-PERFORMANCE NDFEB PERMANENT MAGNET COMPRISING NITRIDE PHASE AND PRODUCTION METHOD THEREOF

(71) Applicant: SHENYANG GENERAL MAGNETIC CO., LTD., Shenyang, Liaoning (CN)

(72) Inventors: Baoyu Sun, Liaoning (CN); Yongli Duan, Liaoning (CN)

(73) Assignee: SHENYANG GENERAL MAGNETIC CO., LTD, Shenyang, Liaoning (CN)

( * ) Notice: Subject to any disclaimer, the term of this patent is extended or adjusted under 35 U.S.C. 154(b) by 483 days.

This patent is subject to a terminal disclaimer.

(21) Appl. No.: 15/382,672

(22) Filed: Dec. 18, 2016

(65) Prior Publication Data

US 2017/0098496 A1 Apr. 6, 2017

(30) Foreign Application Priority Data

Apr. 8, 2016 (CN) ..... 2016 1 0215687

(51) Int. Cl.
*B22F 3/12* (2006.01)
*H01F 1/057* (2006.01)
(Continued)

(52) U.S. Cl.
CPC ..... *C21D 6/007* (2013.01); *B22F 3/101* (2013.01); *B22F 3/16* (2013.01); *B22F 3/162* (2013.01); *C21D 9/00* (2013.01); *C22C 33/02* (2013.01); *C22C 33/04* (2013.01); *C22C 38/002* (2013.01); *C22C 38/005* (2013.01); *C22C 38/06* (2013.01); *C22C 38/10* (2013.01); *C22C 38/14* (2013.01);
(Continued)

(58) Field of Classification Search
None
See application file for complete search history.

(56) References Cited

U.S. PATENT DOCUMENTS

2003/0106615 A1* 6/2003 Hirota ..... C22B 7/002 148/101
2007/0157998 A1* 7/2007 Hirota ..... C22C 1/0441 148/302
(Continued)

*Primary Examiner* — Xiaowei Su

(57) ABSTRACT

A high-performance NdFeB permanent magnet including a nitride phase and a production method thereof are provided. A main phase of the NdFeB permanent magnet has a structure of $R_2T_{14}B$; a grain boundary phase is distributed around the main phase and contains N, F, Zr, Ga and Cu; a composite phase containing R1, Tb and N exists between the main phase and the grain boundary phase and includes a phase having a structure of $(R1, Tb)_2T_{14}(B, N)$. R represents at least two rare earth elements, and includes Pr and Nd; T represents Fe, Mn, Al and Co; R1 represents at least one rare earth element, and includes at least one of Dy and Tb; the main phase contains Pr, Nd, Fe, Mn, Al, Co and B; and the grain boundary phase further contains at least one of Nb and Ti. Through placing partially B by N, a magnetic performance is increased.

13 Claims, 2 Drawing Sheets

(51) Int. Cl.

| | |
|---|---|
| ***H01F 41/02*** | (2006.01) |
| ***C21D 6/00*** | (2006.01) |
| ***C22C 38/16*** | (2006.01) |
| ***C22C 38/14*** | (2006.01) |
| ***C22C 38/10*** | (2006.01) |
| ***C22C 38/06*** | (2006.01) |
| ***C22C 38/00*** | (2006.01) |
| ***C22C 33/04*** | (2006.01) |
| ***B22F 3/16*** | (2006.01) |
| ***C21D 9/00*** | (2006.01) |
| ***H01F 1/059*** | (2006.01) |
| ***B22F 3/10*** | (2006.01) |
| ***C22C 33/02*** | (2006.01) |
| *B22F 1/00* | (2006.01) |

(52) U.S. Cl.

CPC ..... *C22C 38/16* (2013.01); *H01F 1/059* (2013.01); *H01F 41/0293* (2013.01); *B22F 1/0055* (2013.01); *B22F 2998/10* (2013.01); *B22F 2999/00* (2013.01); *C22C 2202/02* (2013.01); *H01F 1/0577* (2013.01)

(56) References Cited

U.S. PATENT DOCUMENTS

| | | | | |
|---|---|---|---|---|
| 2012/0114515 | A1* | 5/2012 | Kaneko | B22F 1/0088 419/10 |
| 2017/0103837 | A1* | 4/2017 | Sun | H01F 1/0577 |
| 2017/0117073 | A1* | 4/2017 | Sun | H01F 1/0577 |

* cited by examiner

HIGH-PERFORMANCE NDFEB PERMANENT MAGNET COMPRISING NITRIDE PHASE AND PRODUCTION METHOD THEREOF

CROSS REFERENCE OF RELATED APPLICATION

The application claims priority under 35 U.S.C. 119(a-d) to CN 201610215687.X, filed Apr. 8, 2016.

BACKGROUND OF THE PRESENT INVENTION

Field of Invention

The present invention relates to a rare earth permanent magnet field, and more particularly to a high-performance NdFeB permanent magnet comprising a nitride phase and a production method thereof.

Description of Related Arts

The NdFeB rare earth permanent magnet is the widely applied basic electronic component and electrical apparatus element in the world, and is widely applied in computer, mobile phone, television, automobile, electrical machine, toy, sound system, automatic equipment, and magnetic resonance imaging. With the energy-saving and low-carbon economy requirements, the NdFeB rare earth permanent magnet is further applied in fields of energy-saving household appliance, hybrid electric vehicle, and wind power generation.

In 1983, the sintered NdFeB rare earth permanent magnet was firstly prepared through the powder metallurgy method by M. sgawaa et al., and the $Nd_2Fe_{14}B$ phase and the grain boundary phase were confirmed to exist in the sintered NdFeB rare earth permanent magnet. The American patent publication, U.S. Pat. No. 5,645,651, granted in 1997, disclosed an R—Fe—Co—B metallographic structure. The emergence of the NdFeB rare earth permanent magnet represents the birth of the third-generation rare earth permanent magnet material. With the application of NdFeB, NdFeB is widely researched. Up to now, people are able to volume-produce the NdFeB rare earth permanent magnet having (BH)max of 52 MGOe; and it is found that: through replacing the light rare earth elements of Pr and Nd by the heavy rare earth elements of Dy, Tb and Ho, the coercive force of the magnet is increased from 12 kOe to 30 kOe, and the service temperature is increased from 80° C. to 180° C. With the application of the NdFeB rare earth permanent magnet in wind power generation, automobile, servo motors, energy-saving motors and electronic devices, the consumption of the heavy rare earth element, Dy, becomes more and more. Dy is a scarce heavy rare earth resource and few in the world, and now only produced from the ionic mineral in south China. A decrease of the consumption of Dy is important for protecting the scarce resource and decreasing the cost of the NdFeB rare earth permanent magnet.

In 1988, Chinese He Shuixiao et al. published an article in the magazine, *Journal of Magnetic Materials and Devices*, in China. He Shuixiao et al. found that: preparing powders through a fluidized-bed jet mill was able to obviously increase a magnetic performance of NdFeB. Thereafter, the fluidized-bed jet mill are popularized and applied in the field of NdFeB. The fluidized-bed jet mill has an obvious advantage that: during preparing the powders through the fluidized-bed jet mill, a portion of ultrafine powders is discharged with an airflow of a discharging pipe of a cyclone collector, wherein a discharging amount is 1-10% of a collecting amount. During the conventional process of preparing powders through the jet mill, because oxygen exists in the jet mill, a portion of ultrafine powders combines with the oxygen and forms oxides containing the rare earth; generally, the portion of ultrafine powders is discharged with the airflow of the discharging pipe of the cyclone collector and enters a filter. Because the ultrafine powders are inflammable, the portion of ultrafine powders is treated as wastes. American patent publications, U.S. Pat. Nos. 6,491,765 and 6,537,385 found that: during preparing powders through the jet mill, through removing part of the ultrafine powders having the particle size smaller than 1 μm, the magnetic performance of NdFeB was increased.

American patent publication, U.S. Pat. No. 6,468,365, and Chinese patent family application thereof, ZL99125012.5 disclosed an R-T-B sintered permanent magnet, wherein: O, C, N and Ca were listed as unavoidable impurities, and the impurities such as N were thought to affect the performance of the NdFeB sintered magnet. In 1990, Professor Yang Yingchang from Beijing University found $SmFe_{12}N$ has an excellent magnetic performance, and further found $NdFe_{12}N$ also has an excellent magnetic performance, wherein the Curie temperature of $NdFe_{12}N$ is higher than the Curie temperature of NdFeB by 200° C. Because $NdFe_{12}N$ is decomposed at temperature above 800° C., until now, it is still failed to produce the $NdFe_{12}N$ magnet, and only magnetic powders and the magnetic film thereof are able to be produced.

In order to increase the magnetic performance of the NdFeB rare earth permanent magnet material and meanwhile decrease the consumption of heavy rare earth materials such as Dy and Tb, Japanese enterprises have made a lot of researches. Japanese Shin-Etsu Chemical Co., Ltd. in Chinese patent publications, CN100520992C, CN100565719C, and CN101404195B, disclosed a high-performance R—Fe—B permanent magnet containing Dy, Tb, F and O. The average concentrations of F, Dy and Tb gradually increase from a center of the magnet to a surface of the magnet, and the distribution trends thereof are showed in FIG. 1. Moreover, rare earth oxyfluorides exist in the grain boundary of the grain boundary area which is from the surface of the magnet to an interior of the magnet at a certain depth. The permanent magnet was prepared through steps of: sintering the NdFeB magnet; adding oxides, fluorides or oxyfluoride powders containing Dy and Tb on the surface of the magnet; processing the magnet with a thermal treatment at a temperature lower than a sintering temperature in vacuo or an inert atmosphere; and absorbing Dy and Tb in the powders into the magnet. Through the above method, the coercive force of the sintered NdFeB permanent magnet is increased to a certain extent. However, according to the above method, the thermal treatment, which enables Dy and Tb to penetrate into the magnet, proceeds after sintering, causing the magnet becoming more crisp and harder, which brings troubles to subsequent machining and processing, leads to the easily broken edges and corners of the products during the transport process, and increases the rejection rate of the products.

SUMMARY OF THE PRESENT INVENTION

According to the prior art, N is regarded as a harmful element in a NdFeB rare earth permanent magnet, which decreases a performance of the NdFeB permanent magnet. It is found by the present invention that: when melting and sintering, an increase of N really decreases a magnetic performance; however, through improving a producing process, increasing an N content during preparing powders through a jet mill, especially increasing an N content of ultrafine powders, controlling sintering process parameters during sintering, removing part of needless N, decreasing a generation of R—N compounds, and allowing N to enter a main phase, the magnetic performance is obviously increased. Moreover, the present invention partially replaces B by N, which increases the magnetic performance of the NdFeB rare earth permanent magnet, especially a coercive force of the NdFeB rare earth permanent magnet.

According to the prior art, removing part of ultrafine powders having a particle size smaller than 1 μm during preparing the powders through the jet mill is thought to be beneficial to increasing the magnetic performance. However, it is found by the present invention that: the ultrafine powders are beneficial for absorbing N; and, an existence of N avoids the ultrafine powders reacting with oxygen. The ultrafine powders absorbing N is a key technology for producing NdFeB with few Dy according to the present invention.

According to a conventional sintering process, a temperature from 600° C. to a sintering temperature gradually increases, and, when the temperature reaches the sintering temperature, the temperature is kept, in such a manner that N is accumulated in a grain boundary phase during sintering, and combines with a rare earth element, R, to form rare earth nitrides. The present invention adopts a fluctuation sintering technology that: after reaching the sintering temperature, the temperature fluctuates in a certain range, in such a manner that an accumulation of N in the grain boundary phase is decreased, and N gradually enters the main phase. An entrance of N into the main phase obviously increases a service temperature of NdFeB, reduces a consumption of Dy, and saves a raw material cost. During an entrance process of N into the main phase, a new phase having a high N content is formed at a periphery of the grains in the main phase and has a thin layer, generally smaller than 400 nm. An existence of the new phase further increases the service temperature of NdFeB.

In order to overcome deficiencies of the prior art, the present invention provides a high-performance NdFeB permanent magnet comprising a nitride phase and a production method thereof.

A high-performance NdFeB permanent magnet comprising a nitride phase is provided, wherein:

an average grain size of the NdFeB permanent magnet is in a range of 3-6 pin; a main phase of the NdFeB permanent magnet has a structure of $R_2T_{14}B$, and a grain boundary phase is distributed around the main phase and contains N, F, Zr, Ga and Cu; a composite phase containing R1, Tb and N exists between the main phase and the grain boundary phase and comprises a phase having a structure of $(R1, Tb)_2T_{14}(B, N)$; R represents at least two rare earth elements, and comprises Pr and Nd; T represents Fe, Mn, Al and Co; R1 represents at least one rare earth element, and comprises at least one of Dy and Tb; the main phase contains Pr, Nd, Fe, Mn, Al, Co and B; and the grain boundary phase further contains at least one of Nb and Ti; and contents of N, F, Mn, Al, Tb, Dy, Pr, Nd, Co, Ga, Zr and Cu in the NdFeB permanent magnet are respectively: 0.03 wt %≤N≤0.09 wt %; 0.005 wt %≤F≤0.5 wt %; 0.011 wt %≤Mn≤0.027 wt %; 0.1 wt %≤Al≤0.6 wt %; 0.1 wt %≤Tb≤2.9 wt %; 0.1 wt %≤Dy≤3.9 wt %; 3 wt %≤Pr≤14 wt %; 13 wt %≤Nd≤28 wt %; 0.6 wt %≤Co≤2.8 wt %; 0.09 wt %≤Ga≤0.19 wt %; 0.06 wt %≤Zr≤0.19 wt %; and 0.08 wt %≤Cu≤0.24 wt %.

Preferably, the composite phase further comprises a phase having structures of $(R, Tb)_2T_{14}(B, N)$ and $(R1, Tb)T_{12}(B, N)$.

Preferably, the NdFeB permanent magnet contains Mn, Nb and Ti, and contents thereof are respectively 0.011 wt %≤Mn≤0.016 wt %, 0.3 wt %≤Nb≤0.9 wt %, and 0.11 wt %≤Ti≤0.19 wt %.

Preferably, the main phase further contains Gd and Ho, and contents thereof are respectively 0.3 wt %≤Gd≤4 wt % and 0.6 wt %≤Ho≤4.9 wt %.

Preferably, a content of Tb in the composite phase is higher than a content of Tb in the main phase and the grain boundary phase; and the content of Tb in the NdFeB permanent magnet is 0.1 wt %≤Tb≤2.8 wt %.

Preferably, contents of Tb and Al in the composite phase is higher than contents of Tb and Al in the main phase and the grain boundary phase; and the contents of Tb and Al in the NdFeB permanent magnet are respectively 0.1 wt %≤Tb≤2.8 wt % and 0.1 wt %≤Al≤0.3 wt %.

The present invention further provides a method for producing a high-performance NdFeB permanent magnet comprising a nitride phase, comprising steps of:

(1) sending a portion of raw materials, comprising pure iron, ferro-boron, and rare earth fluorides, into a crucible of a vacuum melting chamber under a vacuum condition, heating the portion of raw materials to a temperature of 1400-1500° C., refining the portion of raw materials, and obtaining a first melting liquid;

(2) sending a NdFeB slag cleaning device to a surface of the first melting liquid in the crucible of the vacuum melting chamber through a lifting device, absorbing slags to the slag cleaning device, and lifting the slag cleaning device up;

(3) sending a rest of raw materials into the crucible of the vacuum melting chamber, filling argon into the vacuum melting chamber, refining the first melting liquid and the rest of raw materials in the crucible, and obtaining a second melting liquid;

(4) pouring the second melting liquid after refining onto a surface of a water-cooled rotation roller through a tundish, forming alloy flakes, and controlling an average thickness of the alloy flakes in a range of 0.1-0.3 mm;

(5) sending two kinds of alloy flakes, respectively containing R and R1, and $TbF_3$ powders into a vacuum hydrogen decrepitation furnace, and processing with a hydrogen decrepitation process; wherein: at least one kind of alloy flakes is prepared through the steps (1)-(4); during the hydrogen decrepitation process, a heating temperature is controlled in a range of 560-900° C. for more than 2 hours; R represents at least two rare earth elements, and comprises Pr and Nd; R1 represents at least one rare earth element, and comprises at least one of Dy and Tb;

(6) sending the alloy flakes after the hydrogen decrepitation process into a nitrogen jet mill, milling the alloy flakes into powders by the nitrogen jet mill, and controlling an average particle size of the powders in a range of 1.6-3.3 μm;

(7) under a protection of nitrogen, processing the powders with magnetic field pressing, and obtaining a pressed compact with a density controlled at 4.1-4.8 g/cm$^3$;

(8) under the protection of the nitrogen, through evacuating and heating, processing the pressed compact after magnetic field pressing with degassing, purifying and presintering; and forming a presintered block with a presintered density controlled at 5.1-7.2 g/cm$^3$;

(9) machining the presintered block into a part;

(10) attaching powders or a film containing Tb on a surface of the part; and

(11) sending the part, with the surface attached by the powders or the film containing Tb, into a vacuum sintering furnace; processing the part with vacuum sintering and aging, and controlling a vacuum sintering temperature in a range of 960-1070° C. and an aging temperature in a range of 460-640° C.; and obtaining the NdFeB permanent magnet with a density of 7.4-7.7 g/cm$^3$;

wherein: the NdFeB permanent magnet prepared through the above method has an average grain size in a range of 3-7 μm; a content of N in the NdFeB permanent magnet is in a range of 0.03-0.09 wt %; a content of F is in a range of 0.05-0.5 wt %; a content of Tb is in a range of 0.1-2.9 wt %; F exists in a grain boundary phase of the NdFeB permanent magnet, and a composite phase containing Tb and N exists between a main phase and the grain boundary phase.

Preferably, the rare earth fluorides comprise at least one member selected from a group consisting of praseodymium-neodymium fluorides, terbium fluorides, and dysprosium fluorides.

Preferably, in the step (1), the portion of raw materials further comprises NdFeB scraps; a weight of the NdFeB scraps is 20-60% of a total weight of the raw materials; and a weight of the rare earth fluorides is 0.1-3% of the total weight of the raw materials.

Preferably, in the step (1), the portion of raw materials further comprises the NdFeB scraps; during refining, a vacuum degree is controlled in a range of $8\times10^{-1}$-$8\times10^{2}$ Pa; and a content of Mn in the NdFeB permanent magnet is controlled in a range of 0.01-0.016 wt %.

Preferably, in the step (4), after pouring the second melting liquid after refining onto the surface of the water-cooled rotation roller through the tundish, the alloy flakes are formed; and the formed alloy flakes are crushed, then fall into a water-cooled rotation cylinder, and are processed with secondary cooling.

Preferably, in the step (6), the nitrogen jet mill for milling the alloy flakes into the powders is a nitrogen jet mill without discharging ultrafine powders; the powders prepared through the nitrogen jet mill comprise ultrafine powders having a particle size smaller than 1 μm and conventional powders having a particle size larger than 1 μm, and the ultrafine powders have a higher nitrogen content and a higher heavy rare earth element content than the conventional powders; after uniformly mixing the ultrafine powders and the conventional powders, the ultrafine powders surround the conventional powders, and the ultrafine powders surrounding the conventional powders finally form the composite phase in the NdFeB permanent magnet; and, the composite phase has a higher heavy rare earth element content and a higher nitrogen content than the main phase.

Preferably, before "milling the alloy flakes into powders by the nitrogen jet mill" in the step (6), the step (6) further comprises a step of adding a lubricating agent into the alloy flakes after the hydrogen decrepitation process, wherein the lubricating agent contains F.

Preferably, the hydrogen decrepitation process comprises steps of: firstly adding terbium fluoride powders into the alloy flakes; then heating the alloy flakes to a temperature of 50-800° C., and keeping the temperature for 10 minutes to 8 hours; cooling the alloy flakes to 100-390° C.; absorbing hydrogen; heating the alloy flakes to a temperature of 600-900° C. and keeping the temperature; and cooling the alloy flakes to below 200° C.; and the content of Tb in the NdFeB permanent magnet is in a range of 0.1-1.9 wt %.

Preferably, in the step (11), the vacuum sintering temperature is controlled in a range of 1010-1045° C. and the aging temperature is controlled in a range of 460-540° C.; the content of Tb in the NdFeB permanent magnet is controlled in a range of 0.1-2.9 wt %, and the density of the NdFeB permanent magnet is controlled at 7.5-7.7 g/cm$^3$.

Preferably, the step (10) comprises steps of: firstly removing oil from the part, then immersing the part in a solution containing Tb—Al alloy powders, and attaching the Tb—Al alloy powders on the surface of the part; and the step (11) comprises steps of: sending the part, with the surface attached by the Tb—Al alloy powders, into the vacuum sintering furnace; processing the part with vacuum sintering and aging, and controlling the vacuum sintering temperature in a range of 1010-1045° C. and the aging temperature in a range of 460-540° C.; and obtaining the NdFeB permanent magnet with a density of 7.5-7.7 g/cm$^3$; wherein: the content of Tb in the NdFeB permanent magnet is in a range of 0.1-0.4 wt %; a content of Al is in a range of 0.1-0.3 wt %; F exists in the grain boundary phase; and, the composite phase containing Tb and N exists between the main phase and the grain boundary phase, and has a structure of $(R1, Tb)_2T_{14}(B, N)$.

Preferably, in the step (8), the presintered density of the presintered block is controlled at 5.1-6.2 g/cm$^3$; in the step (10), oil is firstly removed from the part and then the part is immersed in a solution containing the terbium fluoride powders; and the step (11) comprises steps of: sending the part containing the terbium fluoride powders into the vacuum sintering furnace; processing the part with vacuum sintering and aging, and controlling the vacuum sintering temperature in a range of 1020-1045° C. and the aging temperature in a range of 470-540° C.; and obtaining the NdFeB permanent magnet with a density of 7.5-7.7 g/cm$^3$; wherein: the NdFeB permanent magnet prepared through the method has an average grain size in a range of 3-6 pin; and, in the NdFeB permanent magnet, a composite phase, having a Tb content higher than an average Tb content of the NdFeB permanent magnet, exists between the main phase and the grain boundary phase.

Preferably, the step (10) comprises a step of: through a pressure immersing method, attaching the powders containing Tb on the surface of the part.

Preferably, the step (10) comprises a step of: through at least one method of sputtering, evaporating and spraying, forming the film containing Tb on the surface of the part.

The present invention has following beneficial effects.

During a conventional process of preparing powders through the nitrogen jet mill, because oxygen exists in the jet mill, a portion of ultrafine powders combines with the oxygen and forms the oxides containing rare earth. Generally, the portion of ultrafine powders is discharged with an airflow of a discharging pipe of a cyclone collector and enters a filter. Because the ultrafine powders are inflammable, the portion of ultrafine powders is treated as wastes. It is found by researches that: after mixing first alloy flakes having an average grain size of 1.6-2.6 μm and second alloy flakes having an average grain size of 1.6-2.6 μm after the hydrogen decrepitation process, during the process of preparing the powders through the nitrogen jet mill without discharging the ultrafine powders, when the average particle size of the powders is in a range of 1.8-2.7 μm and an oxygen content is lower than 100 ppm, the ultrafine powders combine with the nitrogen and form the rare earth nitrides; and, through controlling a sintering process, after sintering, part of the rare earth nitrides enter the main phase and replace B, which obviously increases the service temperature of the permanent magnet.

Although the ultrafine powder nitrides are also generated when preparing the powders through the prior art, the ultrafine powder nitrides are discharged as the ultrafine powders; and, because the remaining rare earth nitrides have a large particle size, during sintering, part of nitrogen components are decomposed and discharged, and the other part of the nitrogen components combine with the rich rare earth and form the rare earth nitrides existing in the grain boundary phase. According to the prior art, the rare earth nitrides are treated as impurities, and an existence of the rare earth nitrides is avoided. According to the present invention, the ultrafine powders are avoided being oxidized through controlling an oxygen content during the process of preparing the powders; through the jet mill without discharging the ultrafine powders, the rare earth nitrides, generated during the process of preparing the powders through the jet mill, are all recycled into powders collected by the collector; the nitrogen is adopted as a jet mill carrier, and the ultrafine powders generated through the jet mill are all back to the collector, react with the nitrogen and form the nitride micropowders containing the rare earth; because the rare earth nitrides are easily oxidized, during the subsequent producing processes, the oxygen content is strictly controlled and generally lower than 100 ppm; and, through improving the sintering process, part of the rare earth nitrides in the grain boundary move to the main phase, and a rare earth nitride phase connected with the main phase is generated at an edge of the grain boundary phase.

Compared with machining after sintering, because the density is low after presintering, a process of machining after presintering has obvious advantages that a machining cost is obviously decreased and a machining efficiency is increased by more than 30%.

These and other objectives, features, and advantages of the present invention will become apparent from the following detailed description, the accompanying drawings, and the appended claims.

DETAILED DESCRIPTION OF THE PREFERRED EMBODIMENT

Figure 1:
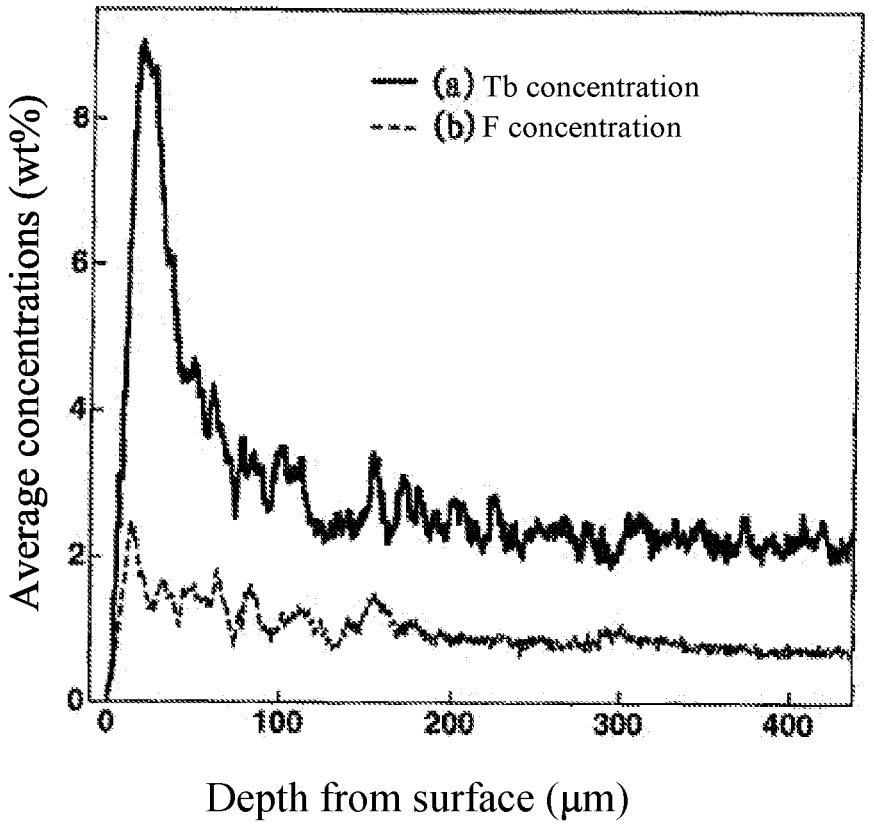
FIG. 1 (prior art)
FIG. 1 shows distribution trends of average concentrations of F and Tb in a magnet according to the prior art, wherein the average concentrations gradually increase from a center of the magnet to a surface of the magnet.

Obvious effects of the present invention are further illustrated with following examples.

Example 1

According to weight percent, preparing raw materials of praseodymium-neodymium alloys, metallic terbium, dysprosium fluorides, dysprosium-ferrum, pure iron, ferro-boron, metallic gallium, metallic zirconium, metallic cobalt, metallic aluminum and metallic copper into an alloy raw material having a composition of $Pr_{6.3}Nd_{23.1}Dy_2Tb_{0.6}B_{0.95}Co_{1.2}Zr_{0.12}Ga_{0.1}Al_{0.2}Cu_{0.2}Fe_{rest}$; loading the pure iron, the ferro-boron, the dysprosium fluorides, and a small amount of the praseodymium-neodymium alloys into a first charging basket; loading a rest of praseodymium-neodymium alloys, the dysprosium-ferrum, the metallic terbium, and the metallic gallium into a second charging basket; loading the metallic zirconium, the metallic cobalt, the metallic aluminum and the metallic copper into a third charging basket; sending the three charging baskets into a vacuum loading chamber of a vacuum melting rapid-solidifying device; after evacuating, opening the vacuum loading chamber and a vacuum valve of a vacuum melting chamber; through a cooperation among a lifting device, a multistage rotation plate, and a trolley which moves back and forth, sending the raw materials in the first charging basket to a crucible of the vacuum melting chamber under a vacuum condition, heating to 1400-1500° C., refining the raw materials, and obtaining a first melting liquid; through the lifting device, sending a NdFeB slag cleaning device to a surface of the first melting liquid in the crucible of the vacuum melting chamber, absorbing slags to the slag cleaning device, and lifting the slag cleaning device up; adding the raw materials in the second charging basket and the third charging basket into the crucible of the vacuum melting chamber, filling argon into the vacuum melting chamber, refining the first melting liquid and the raw materials in the crucible, and obtaining a second melting liquid; after refining, tilting the crucible, pouring the second melting liquid onto a surface of a water-cooled rotation roller through a tundish, and forming an alloy flake material; leaving the water-cooled rotation roller and then falling into an alloy flake crushing device of an alloy flake cooling chamber by the alloy flake material, crushing the alloy flake material, then falling into a water-cooled rotation cylinder by the crushed alloy flake material, processing the crushed alloy flake material with secondary cooling, and forming first alloy flakes; sending the first alloy flakes and second alloy flakes having a composition of $(Pr_{0.25}Nd_{0.75})_{30.1}Fe_{rest}Co_{0.6}Al_{0.1}B_{0.95}Cu_{0.1}\ Ga_{0.1}Zr_{0.14}$ into a vacuum hydrogen decrepitation furnace, and processing the first alloy flakes and the second alloy flakes with a hydrogen decrepitation process, wherein the hydrogen decrepitation process comprises steps of: adding terbium fluoride powders into the first and second alloy flakes, then heating the first and second alloy flakes to a temperature of 650° C., keeping the temperature at 650° C. for 2 hours, cooling the first and second alloy flakes to 260° C., absorbing hydrogen, heating the first and second alloy flakes to the temperature of 650° C. again and keeping the temperature, and finally cooling the first and second alloy flakes to below 200° C.; sending the first and second alloy flakes after the hydrogen decrepitation process into a nitrogen jet mill without discharging ultrafine powders, milling the first and second alloy flakes into powders by the nitrogen jet mill, and controlling an average particle size of the powders at about 2.0-2.2 μm; processing the powders with magnetic field pressing, obtaining a pressed compact, and presintering the pressed compact into a presintered block with a presintered density of about 5.8 $g/cm^3$; machining the presintered block into a part; removing oil from the part, and then immersing the part into a solution containing the terbium fluoride powders; sending the part containing the terbium fluoride powders into a vacuum sintering furnace, processing the part with vacuum sintering and aging, and controlling a vacuum sintering temperature at about 1040° C. and an aging temperature at about 505° C.; and, after subsequent processes, obtaining a NdFeB permanent magnet D1 with a density of 7.5 $g/cm^3$.

Figure 2:
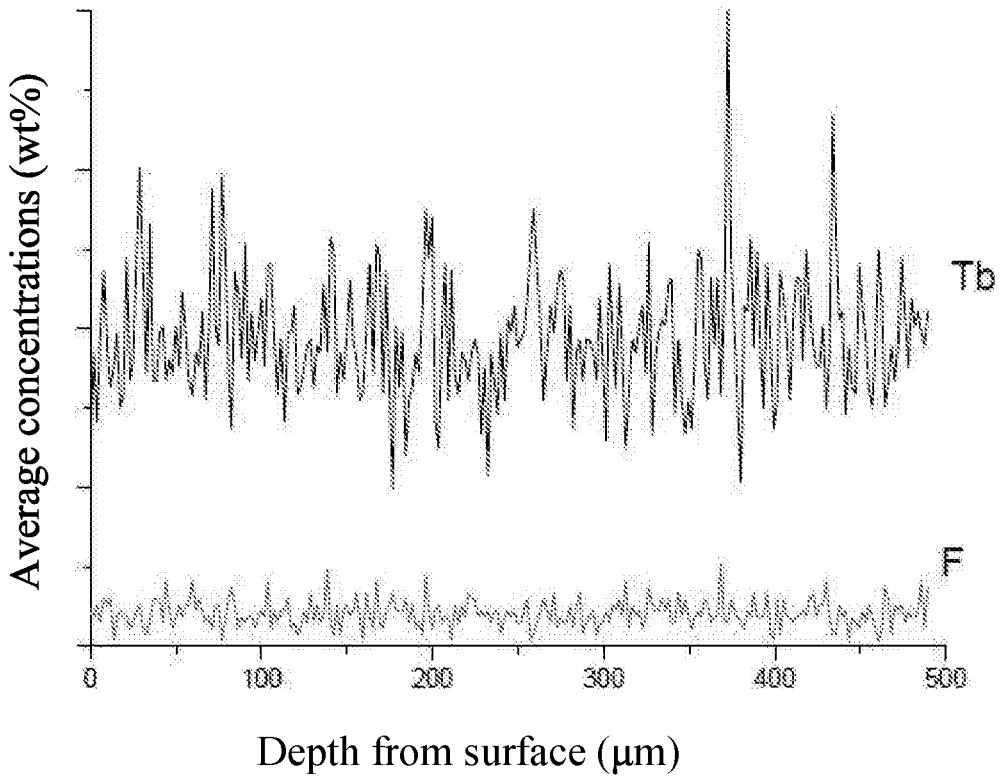
FIG. 2 shows distribution trends of average concentrations of F and Tb in a NdFeB permanent magnet D1, relative to a depth from a surface of the NdFeB permanent magnet D1, according to a first example of the present invention.

Through detecting, it is found that the NdFeB permanent magnet D1 has a magnetic energy product of 50 MGOe and a coercive force of 25 kOe. FIG. 2 shows distribution trends of average concentrations of F and Tb in the NdFeB permanent magnet D1, relative to a depth from a surface of the NdFeB permanent magnet D1. From FIG. 2, it is seen that F and Tb are relatively uniformly distributed in the NdFeB permanent magnet D1; and the average concentrations of F and Tb are not in a trend showed in FIG. 1 that gradually increases from a center of the magnet to a surface of the magnet. NdFeB permanent magnet products, in the same batch of the NdFeB permanent magnet D1, have few broken edges and corners, and a low rejection rate.

Alternatively, it is feasible to machine the presintered block into the part, and then immerse the part into any other solution containing powders of Tb, or attach powders containing Tb on a surface of the part though a pressure immersing method, or form a film containing Tb on the surface of the part though at least one method of sputtering, evaporating and spraying; next, the part, with the surface attached by the powders or the film containing Tb, is sent into the vacuum sintering furnace and processed with vacuum sintering, aging, and subsequent processes. The obtained permanent magnet has a similar magnetic performance as the NdFeB permanent magnet D1. Permanent magnet products, in the same batch of the permanent magnet, have few broken edges and corners, and a low rejection rate. F and Tb are relatively uniformly distributed in the permanent magnet; and average concentrations of F and Tb are not in the trend showed in FIG. 1 that gradually increases from the center of the magnet to the surface of the magnet.

Contrast Example 1

According to weight percent, preparing raw materials of praseodymium-neodymium alloys, metallic terbium, dysprosium-ferrum, pure iron, ferro-boron, metallic gallium, metallic zirconium, metallic cobalt, metallic aluminum and metallic copper into an alloy raw material having a composition of $Pr_{6.3}Nd_{23.1}Dy_2Tb_{0.6}B_{0.05}Co_{1.2}Zr_{0.12}Ga_{0.1}Al_{0.2}Cu_{0.2}Fe_{rest}$; loading the pure iron, the ferro-boron, and a small amount of the praseodymium-neodymium alloys into a first charging basket; loading a rest of praseodymium-neodymium alloys, the dysprosium-ferrum, the metallic terbium, and the metallic gallium into a second charging basket; loading the metallic zirconium, the metallic cobalt, the metallic aluminum and the metallic copper into a third charging basket; melting the raw materials in the three charging baskets with the same steps in the example 1, and forming third alloy flakes having a same composition as the first alloy flakes in the example 1; sending the third alloy flakes and second alloy flakes having a composition of $(Pr_{0.25}Nd_{0.75})_{30.1}Fe_{rest}Co_{0.6}Al_{0.1}B_{0.95}Cu_{0.1}Ga_{0.1}Zr_{0.14}$ into a vacuum hydrogen decrepitation furnace, and processing the third alloy flakes and the second alloy flakes with a hydrogen decrepitation process, wherein the hydrogen decrepitation process comprises steps of: heating the third and second alloy flakes to a temperature of 260° C., absorbing hydrogen, heating the third and second alloy flakes to a temperature of 650° C. and keeping the temperature, and finally cooling the third and second alloy flakes to below 200° C.; sending the third and second alloy flakes after the hydrogen decrepitation process into a conventional nitrogen jet mill, milling the third and second alloy flakes into powders by the conventional nitrogen jet mill, and controlling an average particle size of the powders at about 3.3-3.6 μm; with the same steps in the example 1, processing the powders with magnetic field pressing, obtaining a pressed compact, presintering the pressed compact into a presintered block, machining the presintered block into a part, removing oil from the part, and immersing the part into a solution containing terbium fluoride powders; sending the part containing the terbium fluoride powders into a vacuum sintering furnace, processing the part with vacuum sintering and aging; and, after subsequent processes, obtaining a NdFeB permanent magnet C1.

Through detecting, it is found that the NdFeB permanent magnet C1 has a magnetic energy product of 45 MGOe and a coercive force of 21 kOe. NdFeB permanent magnet products, in the same batch of the NdFeB permanent magnet C1, have few broken edges and corners, and a low rejection rate.

Contrast Example 2

According to weight percent, preparing raw materials of praseodymium-neodymium alloys, metallic terbium, dysprosium-ferrum, pure iron, ferro-boron, metallic gallium, metallic zirconium, metallic cobalt, metallic aluminum and metallic copper into an alloy raw material having a composition of $Pr_{6.3}Nd_{23.1}Dy_2Tb_{0.6}B_{0.95}Co_{1.2}Zr_{0.12}Ga_{0.1}Al_{0.2}Cu_{0.2}Fe_{rest}$; loading the pure iron, the ferro-boron, and a small amount of the praseodymium-neodymium alloys into a first charging basket; loading a rest of praseodymium-neodymium alloys, the dysprosium-ferrum, the metallic terbium, and the metallic gallium into a second charging basket; loading the metallic zirconium, the metallic cobalt, the metallic aluminum and the metallic copper into a third charging basket; melting the raw materials in the three charging baskets with the same steps in the example 1, and forming third alloy flakes having a same composition as the first alloy flakes in the example 1; sending the third alloy flakes and second alloy flakes having a composition of $(Pr_{0.25}Nd_{0.75})_{30.1}Fe_{rest}Co_{0.6}Al_{0.1}B_{0.95}Cu_{0.1}Ga_{0.1}Zr_{0.14}$ into a vacuum hydrogen decrepitation furnace, and processing the third alloy flakes and the second alloy flakes with a hydrogen decrepitation process, wherein the hydrogen decrepitation process comprises steps of: heating the third and second alloy flakes to a temperature of 260° C., absorbing hydrogen, heating the third and second alloy flakes to a temperature of 650° C. and keeping the temperature, and finally cooling the third and second alloy flakes to below 200° C.; sending the third and second alloy flakes after the hydrogen decrepitation process into a conventional nitrogen jet mill, milling the third and second alloy flakes into powders by the conventional nitrogen jet mill, and controlling an average particle size of the powders at about 3.3-3.6 μm; processing the powders with magnetic field pressing, obtaining a pressed compact, processing the pressed compact with sintering and aging, and obtaining a sintered block, wherein a vacuum sintering temperature is controlled at about 1040° C., an aging temperature is controlled at about 505° C., and a density of the sintered block is controlled at 7.5 g/cm$^3$; machining the sintered block into a part; removing oil from the part, and immersing the part into a solution containing terbium fluoride powders; processing the part containing the terbium fluoride powders with a diffusing heat treatment at a temperature below the sintering temperature; and, after subsequent processes, obtaining a NdFeB permanent magnet C2.

Through detecting, it is found that the NdFeB permanent magnet C2 has a magnetic energy product of 45 MGOe and a coercive force of 21 kOe. NdFeB permanent magnet products, in the same batch of the NdFeB permanent magnet C2, have obviously more broken edges and corners than the products in the same batch of the NdFeB permanent magnet D1 and the NdFeB permanent magnet C1, and a relatively high rejection rate.

Example 2

According to weight percent, preparing raw materials of praseodymium-neodymium alloys, metallic terbium, dysprosium fluorides, dysprosium-ferrum, pure iron, ferro-boron, metallic gallium, metallic zirconium, metallic cobalt, metallic aluminum and metallic copper, and NdFeB scraps into an alloy raw material having a composition of $Pr_{6.3}Nd_{23.1}Dy_{1.5}Tb_{1.0}B_{0.95}Co_{1.2}Zr_{0.12}Ga_{0.1}Al_{0.2}Cu_{0.2}Fe_{rest}$; loading the pure iron, the ferro-boron, the dysprosium fluorides, and a small amount of the praseodymium-neodymium alloys into a first charging basket; loading the NdFeB scraps into a second charging basket; loading a rest of praseodymium-neodymium alloys, the dysprosium-ferrum, the metallic terbium, and the metallic gallium into a third charging basket; loading the metallic zirconium, the metallic cobalt, the metallic aluminum and the metallic copper into a fourth charging basket; sending the four charging baskets into a vacuum loading chamber of a vacuum melting rapid-solidifying device; after evacuating, opening the vacuum loading chamber and a vacuum valve of a vacuum melting chamber; through a cooperation among a lifting device, a multistage rotation plate, and a trolley which moves back and forth, sending the raw materials in the first charging basket and the second charging basket into a crucible of the vacuum melting chamber under a vacuum condition, heating to 1400-1500° C., refining the raw materials, and obtaining a first melting liquid; through the lifting device, sending a NdFeB slag cleaning device to a surface of the first melting liquid in the crucible of the vacuum melting chamber, absorbing slags to the slag cleaning device, and lifting the slag cleaning device up; sending the raw materials in the third charging basket and the fourth charging basket into the crucible of the vacuum melting chamber, filling argon into the vacuum melting chamber, refining the first melting liquid and the raw materials in the crucible, and obtaining a second melting liquid; after refining, tilting the crucible, pouring the second melting liquid onto a surface of a water-cooled rotation roller through a tundish, and forming an alloy flake material; leaving the water-cooled rotation roller and then falling into an alloy flake crushing device of an alloy flake cooling chamber by the alloy flake material, crushing the alloy flake material, then falling into a water-cooled rotation cylinder by the crushed alloy flake material, processing the crushed alloy flake material with secondary cooling, and forming third alloy flakes; sending the third alloy flakes and fourth alloy flakes having a composition of $(Pr_{0.25}Nd_{0.75})_{30.5}Fe_{rest}Co_{0.6}Al_{0.1}B_{0.95}Cu_{0.1}Ga_{0.1}Zr_{0.14}$ into a vacuum hydrogen decrepitation furnace, and processing the third alloy flakes and the fourth alloy flakes with a hydrogen decrepitation process, wherein the hydrogen decrepitation process comprises steps of: adding terbium fluoride powders into the third and fourth alloy flakes, then heating the third and fourth alloy flakes to a temperature of 700° C., keeping the temperature at 700° C. for 2 hours, cooling to 260° C., absorbing hydrogen, heating the third and fourth alloy flakes to a temperature of 650° C. and keeping the temperature, and finally cooling the third and fourth alloy flakes to below 200° C.; sending the third and fourth alloy flakes after the hydrogen decrepitation process into a nitrogen jet mill without discharging ultrafine powders, milling the third and fourth alloy flakes into powders by the nitrogen jet mill, and controlling an average particle size of the powders at about 2.0-2.2 μm; processing the powders with magnetic field pressing, obtaining a pressed compact, and presintering the pressed compact into a presintered block with a presintered density of 6.0 g/cm$^3$; machining the presintered block into a part, removing oil from the part, and immersing the part into a solution containing Tb—Al alloy powders; sending the part containing the Tb—Al alloy powders into a vacuum sintering furnace, processing the part with vacuum sintering and aging, and controlling a vacuum sintering temperature at about 1040° C. and an aging temperature at about 505° C.; and, after subsequent processes, obtaining a NdFeB permanent magnet D2 with a density of 7.4 g/cm$^3$.

Through detecting, it is found that the NdFeB permanent magnet D2 has a magnetic energy product of 50 MGOe and a coercive force of 26 kOe. NdFeB permanent magnet products, in the same batch of the NdFeB permanent magnet D2, have few broken edges and corners, and a low rejection rate.

Alternatively, it is feasible to machine the presintered block into the part, and then immerse the part into any other solution containing powders of Tb, or attach the powders containing Tb on a surface of the part though a pressure immersing method, or form a film containing Tb on the surface of the part though at least one method of sputtering, evaporating and spraying; next, the part, with the surface attached by the powders or the film containing Tb, is sent into the vacuum sintering furnace and processed with vacuum sintering, aging, and subsequent processes. The formed permanent magnet has a similar magnetic performance as the NdFeB permanent magnet D2. Permanent magnet products, in the same batch of the permanent magnet, have few broken edges and corners, and a low rejection rate.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method for producing a NdFeB permanent magnet comprising a nitride phase, comprising steps of:

(1) sending a portion of raw materials, comprising pure iron, ferro-boron, and rare earth fluorides, into a crucible of a vacuum melting chamber under a vacuum condition, heating the portion of raw materials to a temperature of 1400-1500° C., refining the portion of raw materials, and obtaining a first melting liquid;

(2) sending a NdFeB slag cleaning device to a surface of the first melting liquid in the crucible of the vacuum melting chamber through a lifting device, absorbing slags to the slag cleaning device, and lifting the slag cleaning device up;

(3) sending a rest of raw materials into the crucible of the vacuum melting chamber, filling argon into the vacuum melting chamber, refining the first melting liquid and the rest of raw materials in the crucible, and obtaining a second melting liquid;

(4) pouring the second melting liquid after refining onto a surface of a water-cooled rotation roller through a tundish, forming alloy flakes, and controlling an average thickness of the alloy flakes in a range of 0.1-0.3 mm;

(5) sending two kinds of alloy flakes, respectively containing R and R1, and $TbF_3$ powders into a hydrogen decrepitation furnace, and processing with a hydrogen decrepitation process; wherein: at least one kind of alloy flakes is prepared through the steps (1)-(4); during the hydrogen decrepitation process, a heating temperature is controlled in a range of 560-900° C. for more than 2 hours; R represents at least two rare earth elements, and comprises Pr and Nd; R1 represents at least one rare earth element, and comprises at least one of Dy and Tb;

(6) sending the alloy flakes after the hydrogen decrepitation process into a nitrogen jet mill, milling the alloy flakes into powders by the nitrogen jet mill, and controlling an average particle size of the powders in a range of 1.6-3.3 μm;

(7) under a protection of nitrogen, processing the powders with magnetic field pressing, and obtaining a pressed compact with a density controlled at 4.1-4.8 g/cm$^3$;

(8) under the protection of the nitrogen, through evacuating and heating, processing the pressed compact after magnetic field pressing with degassing, purifying and presintering; and forming a presintered block with a presintered density controlled at 5.1-7.2 g/cm$^3$;

(9) machining the presintered block into a part;

(10) attaching powders or a film containing Tb on a surface of the part; and

(11) sending the part, with the surface attached by the powders or the film containing Tb, into a vacuum sintering furnace; processing the part with vacuum sintering and aging, controlling a vacuum sintering temperature in a range of 960-1070° C. and an aging temperature in a range of 460-640° C.; and obtaining the NdFeB permanent magnet with a density of 7.4-7.7 g/cm$^3$;

wherein: an average grain size of the NdFeB permanent magnet is in a range of 3-6 μm; a main phase of the NdFeB permanent magnet has a structure of $R_2T_{14}B$, and a grain boundary phase is distributed around the main phase and contains N, F, Zr, Ga and Cu; a composite phase containing R1, Tb and N exists between the main phase and the grain boundary phase and comprises a phase having a structure of $(R1, Tb)_2T_{14}(B, N)$; R represents at least two rare earth elements, and comprises Pr and Nd; T represents Fe, Mn, Al and Co; R1 represents at least one rare earth element, and comprises at least one of Dy and Tb; the main phase contains Pr, Nd, Fe, Mn, Al, Co and B; and the grain boundary phase further contains at least one of Nb and Ti; and contents of N, F, Mn, Al, Tb, Dy, Pr, Nd, Co, Ga, Zr and Cu in the NdFeB permanent magnet are respectively: 0.03 wt %≤N≤0.09 wt %; 0.005 wt %≤F≤0.5 wt %; 0.011 wt %≤Mn≤0.027 wt %; 0.1 wt %≤Al≤0.6 wt %; 0.1 wt %≤Tb≤2.9 wt %; 0.1 wt %≤Dy≤3.9 wt %; 3 wt %≤Pr≤14 wt %; 13 wt %≤Nd≤28 wt %; 0.6 wt %≤Co≤2.8 wt %; 0.09 wt %≤Ga≤0.19 wt %; 0.06 wt %≤Zr≤0.19 wt %; and 0.08 wt %≤Cu≤0.24 wt %.

2. The method for producing the NdFeB permanent magnet comprising the nitride phase, as recited in claim 1, wherein: in the step (1), the rare earth fluorides comprise at least one member selected from the group consisting of praseodymium-neodymium fluorides, terbium fluorides, and dysprosium fluorides.

3. The method for producing the NdFeB permanent magnet comprising the nitride phase, as recited in claim 1, wherein: in the step (1), the portion of raw materials further comprises NdFeB scraps; a weight of the NdFeB scraps is 20-60% of a total weight of the raw materials; and a weight of the rare earth fluorides is 0.1-3% of the total weight of the raw materials.

4. The method for producing the NdFeB permanent magnet comprising the nitride phase, as recited in claim 1, wherein: in the step (1), the portion of raw materials further comprises NdFeB scraps; during refining, a vacuum degree is controlled in a range of $8\times10^{-1}$-$8\times10^{2}$ Pa; and the content of Mn in the NdFeB permanent magnet is controlled in a range of 0.01-0.016 wt %.

5. The method for producing the NdFeB permanent magnet comprising the nitride phase, as recited in claim 1, wherein: the hydrogen decrepitation process comprises steps of: firstly adding terbium fluoride powders into the alloy flakes; then heating the alloy flakes to a temperature of 400-800° C., and keeping the temperature for 10 minutes to 8 hours; cooling the alloy flakes to 100-390° C.; absorbing hydrogen; heating the alloy flakes to a temperature of 600-900° C. and keeping the temperature; and cooling the alloy flakes to below 200° C.; and the content of Tb in the NdFeB permanent magnet is in a range of 0.1-1.9 wt %.

6. The method for producing the NdFeB permanent magnet comprising the nitride phase, as recited in claim 1, wherein: in the step (4), after pouring the second melting liquid after refining onto the surface of the water-cooled rotation roller through the tundish, the alloy flakes are formed, the formed alloy flakes are crushed, then fall into a water-cooled rotation cylinder, and are processed with secondary cooling.

7. The method for producing the NdFeB permanent magnet comprising the nitride phase, as recited in claim 1, wherein: in the step (6), the nitrogen jet mill for milling the alloy flakes into the powders is a nitrogen jet mill without discharging ultrafine powders; the powders prepared through the nitrogen jet mill comprise ultrafine powders having a particle size smaller than 1 μm and conventional powders having a particle size larger than 1 μm, and the ultrafine powders have a higher nitrogen content and a higher heavy rare earth element content than the conventional powders; after uniformly mixing the ultrafine powders and the conventional powders, the ultrafine powders surround the conventional powders.

8. The method for producing the NdFeB permanent magnet comprising the nitride phase, as recited in claim 1, wherein: before "milling the alloy flakes into powders by the nitrogen jet mill" in the step (6), the step (6) further comprises a step of adding a lubricating agent into the alloy flakes after the hydrogen decrepitation process; and the lubricating agent contains F.

9. The method for producing the NdFeB permanent magnet comprising the nitride phase, as recited in claim 1, wherein: in the step (11), the vacuum sintering temperature is controlled in a range of 1010-1045° C., and the aging temperature is controlled in a range of 460-540° C.; the content of Tb in the NdFeB permanent magnet is controlled in a range of 0.1-2.8 wt %, and the density of the NdFeB permanent magnet is controlled at 7.5-7.7 g/cm$^3$.

10. The method for producing the NdFeB permanent magnet comprising the nitride phase, as recited in claim 1, wherein: the step (10) comprises steps of: immersing the part in a solution containing Tb—Al alloy powders, and attaching the Tb—Al alloy powders on the surface of the part; and the step (11) comprises steps of: sending the part, with the surface attached by the Tb—Al alloy powders, into the vacuum sintering furnace; processing the part with vacuum sintering and aging, and controlling the vacuum sintering temperature in a range of 1010-1045° C. and the aging temperature in a range of 460-540° C.; and obtaining the NdFeB permanent magnet with a density of 7.5-7.7 g/cm$^3$; the content of Tb in the NdFeB permanent magnet is in a range of 0.1-0.4 wt %; the content of Al is in a range of 0.1-0.3 wt %; F exists in the grain boundary phase; and, the composite phase containing Tb and N exists between the main phase and the grain boundary phase, and has a structure of $(R1, Tb)_2T_{14}(B, N)$.

11. The method for producing the NdFeB permanent magnet comprising the nitride phase, as recited in claim 1, wherein: in the step (8), the presintered density of the presintered block is controlled at 5.1-6.2 g/cm$^3$; the step (10) comprises steps of: immersing the part in a solution containing terbium fluoride powders, and attaching the terbium fluoride powders on the surface of the part; and the step (11) comprises steps of: sending the part, with the surface attached by the terbium fluoride powders, into the vacuum sintering furnace; processing the part with vacuum sintering and aging, and controlling the vacuum sintering temperature in a range of 1020-1045° C. and the aging temperature in a range of 470-540° C.; and obtaining the NdFeB permanent magnet with a density of 7.5-7.7 g/cm$^3$; the NdFeB permanent magnet prepared through the method has the average grain size in the range of 3-6 μm; and, in the NdFeB permanent magnet, a composite phase, having a Tb content higher than an average Tb content of the NdFeB permanent magnet, exists between the main phase and the grain boundary phase.

12. The method for producing the NdFeB permanent magnet comprising the nitride phase, as recited in claim 1, wherein: the step (10) comprises a step of: through a pressure immersing method, attaching the powders containing Tb on the surface of the part.

13. The method for producing the NdFeB permanent magnet comprising the nitride phase, as recited in claim 1, wherein: the step (10) comprises a step of: through at least one method of sputtering, evaporating and spraying, forming the film containing Tb on the surface of the part.

* * * * *